US006032010A

United States Patent [19]

Kim et al.

[11] Patent Number: 6,032,010

[45] Date of Patent: Feb. 29, 2000

[54] INK SUPPLY APPARATUS FOR WET ELECTROPHOTOGRAPHIC PRINTER

[75] Inventors: Jong-woo Kim, Yongin; Chung-guk Baek, Suwon; Won-hyung Lee, Seoul, all of Rep. of Korea

[73] Assignee: Samsung Electronics Co., Ltd., Kyungki-do, Rep. of Korea

[21] Appl. No.: 09/097,594

[22] Filed: Jun. 16, 1998

[30] Foreign Application Priority Data

Feb. 27, 1998 [KR] Rep. of Korea ..... 98-6487

[51] Int. Cl.[7] ..... G03G 15/10; B41J 2/175

[52] U.S. Cl. ..... 399/238; 399/12; 399/120; 347/86; 222/DIG. 1

[58] Field of Search ..... 399/12, 13, 119, 399/120, 238, 237, 224, 233, 258, 262, 260; 222/DIG. 1, 481.5, 209, 325; 347/85, 86, 214; 141/94

[56] References Cited

U.S. PATENT DOCUMENTS

| | | | |
|---|---|---|---|
| Re. 34,437 | 11/1993 | Ariyama et al. | 399/225 |
| 4,456,367 | 6/1984 | Szymanski et al. | 399/233 |
| 4,878,091 | 10/1989 | Morita et al. | 399/224 |
| 5,058,778 | 10/1991 | Weinstein | 222/209 |
| 5,156,308 | 10/1992 | Aoyama | 222/145 |
| 5,248,847 | 9/1993 | Aoyama . | |
| 5,392,102 | 2/1995 | Toyoizumi et al. | 399/228 |
| 5,396,316 | 3/1995 | Smith . | |
| 5,417,258 | 5/1995 | Privas | 141/94 X |
| 5,426,492 | 6/1995 | Diehl | 399/262 |
| 5,504,511 | 4/1996 | Nakajima et al. | 347/86 |
| 5,530,531 | 6/1996 | Girard | 399/120 |
| 5,631,681 | 5/1997 | Klaus et al. | 347/85 |
| 5,640,644 | 6/1997 | Kimura et al. | 399/224 X |
| 5,689,761 | 11/1997 | Denton et al. | 399/237 X |
| 5,742,310 | 4/1998 | Kotaki | 347/86 |
| 5,802,435 | 9/1998 | Trask et al. | 399/224 |

FOREIGN PATENT DOCUMENTS

| | | |
|---|---|---|
| 49-96952 | 12/1974 | Japan . |
| 4-36780 | 2/1992 | Japan . |
| 4-55053 | 5/1992 | Japan . |
| 5-262394 | 10/1993 | Japan . |
| 5-313502 | 11/1993 | Japan . |
| 8-137285 | 5/1996 | Japan . |

*Primary Examiner*—Matthew S. Smith
*Attorney, Agent, or Firm*—Sughrue, Mion, Zinn, Macpeak & Seas, PLLC

[57] ABSTRACT

An ink supply apparatus for a wet electrophotographic printer. The ink supply apparatus includes a housing having an installation portion, an ink cartridge installed in the housing, for supplying ink to a developing unit, a detachable refill cartridge loaded in the installation portion, for supplying ink to the ink cartridge, and an ink supply device for supplying ink to the ink cartridge from the refill cartridge.

2 Claims, 9 Drawing Sheets

INK SUPPLY APPARATUS FOR WET ELECTROPHOTOGRAPHIC PRINTER

BACKGROUND OF THE INVENTION

1. Field of the Invention

The present invention relates to a wet electrophotographic printer and, more particularly, to an ink supply apparatus for a wet electrophotographic printer having an improved structure.

2. Description of the Related Art

In general, a wet electrophotographic printer develops a latent electrostatic image formed on a photosensitive medium such as a photosensitive belt using a developer liquid having a predetermined color, and transfers the developed image onto paper, thereby printing an intended image.

In a conventional ink supply apparatus for a conventional wet electrophotographic printer, an ink cartridge which serves as a supply source is installed to be detachable in a printer main body in order to supply ink to a developing unit. Thus, it is necessary for the ink cartridge to be set at a position from which the ink cartridge can be easily detachable. Further, there is a drawback in that the ink supply path between the developing unit and the ink cartridge is usually comparatively long. Also, functional parts such as an agitator, a dripless valve, an air hole and an attach/detachment equipment are installed in the ink cartridge, so that replacing the entire ink cartridge increases the costs.

SUMMARY OF THE INVENTION

To solve the above problems, it is an object of the present invention to provide an ink supply apparatus for a wet electrophotographic printer having an improved structure.

According to an aspect of the present invention, there is provided an ink supply apparatus for a wet electrophotographic printer, comprising: a housing having an installation portion; an ink cartridge, installed in the housing, for supplying ink to a developing unit; a detachable refill cartridge loaded in the installation portion, for supplying ink to the ink cartridge; and means for supplying ink to the ink cartridge from the refill cartridge.

Preferably, the ink supply means comprises: a first valve element installed at a discharge hole of the refill cartridge; and a second valve element installed to lead to an intake hole of the ink cartridge, and to couple with the first valve element, wherein the first valve element and the second valve element are coupled to each other when the refill cartridge is loaded in the installation portion, so that the discharge hole of the refill cartridge leads to the intake hole of the ink cartridge.

Preferably, the installation portion, the refill cartridge and the ink cartridge are provided as a plurality of installation portions, refill cartridges and ink cartridges, respectively, for each color and the ink supply apparatus further comprises a color identifying/installing means for allowing the refill cartridge to be coupled with the corresponding installation portion by color.

Preferably, the color identifying/installing means comprises: a protrusion formed at different portions of each refill cartridge by color; and a groove formed in the installation portion corresponding to the refill cartridge to be coupled with the protrusion.

According to another aspect of the present invention, there is provided an ink supply apparatus for a wet electrophotographic color printer, comprising: a housing having an installation portion; a plurality of ink cartridges installed in the housing, for supplying ink having a predetermined color to corresponding developing units; a plurality of detachable refill cartridges installed in the installation portion, for supplying ink having a predetermined color to a corresponding one of the ink cartridges; and color identifying/installing means for allowing ink having a predetermined color to be supplied to the corresponding ink cartridge from a corresponding one of the refill cartridges.

Preferably, the color identifying/installing means comprises: a protrusion formed at different positions for each refill cartridge by color; a plurality of grooves formed in the installation portion to be coupled with a corresponding protrusion; a discharge hole formed in different positions for each refill cartridge by color; a first valve element installed at each discharge hole; and a plurality of second valve elements installed in the installation portion to be connected with an ink intake hole of the ink cartridge, each of which is coupled with a corresponding first valve element by color when the refill cartridges are installed in the installation portion.

Preferably, the color identifying/installing means comprises: an indicator formed at each refill cartridge, for indicating the color of ink contained in the refill cartridge; a sensor for sensing the indicator to detect the color of ink contained in the refill cartridge; a discharge hole formed in different positions for each refill cartridge by color; a first valve element installed at each discharge hole; a plurality of second valve elements connected with an ink intake hole of the ink cartridge, each of which is coupled with a corresponding first valve element; a rotary plate on which the plurality of second valve elements are installed; and a driving source for rotating the rotary plate, wherein the rotary plate is rotated by the driving source according to a detected signal of the sensor when the refill cartridges are loaded in the installation portion, thereby coupling the first valve elements and the second valve elements corresponding to each other.

BRIEF DESCRIPTION OF THE DRAWINGS

The above object and advantages of the present invention will become more apparent by describing in detail preferred embodiments thereof with reference to the accompanying drawings, in which.

DETAILED DESCRIPTION OF THE PREFERRED EMBODIMENTS

According to the present invention, an ink cartridge for storing ink to be supplied to a developing unit and a refill cartridge for supplying ink to the ink cartridge are separately installed, and only the refill cartridge is replaced when ink is completely consumed.

Figure 1:
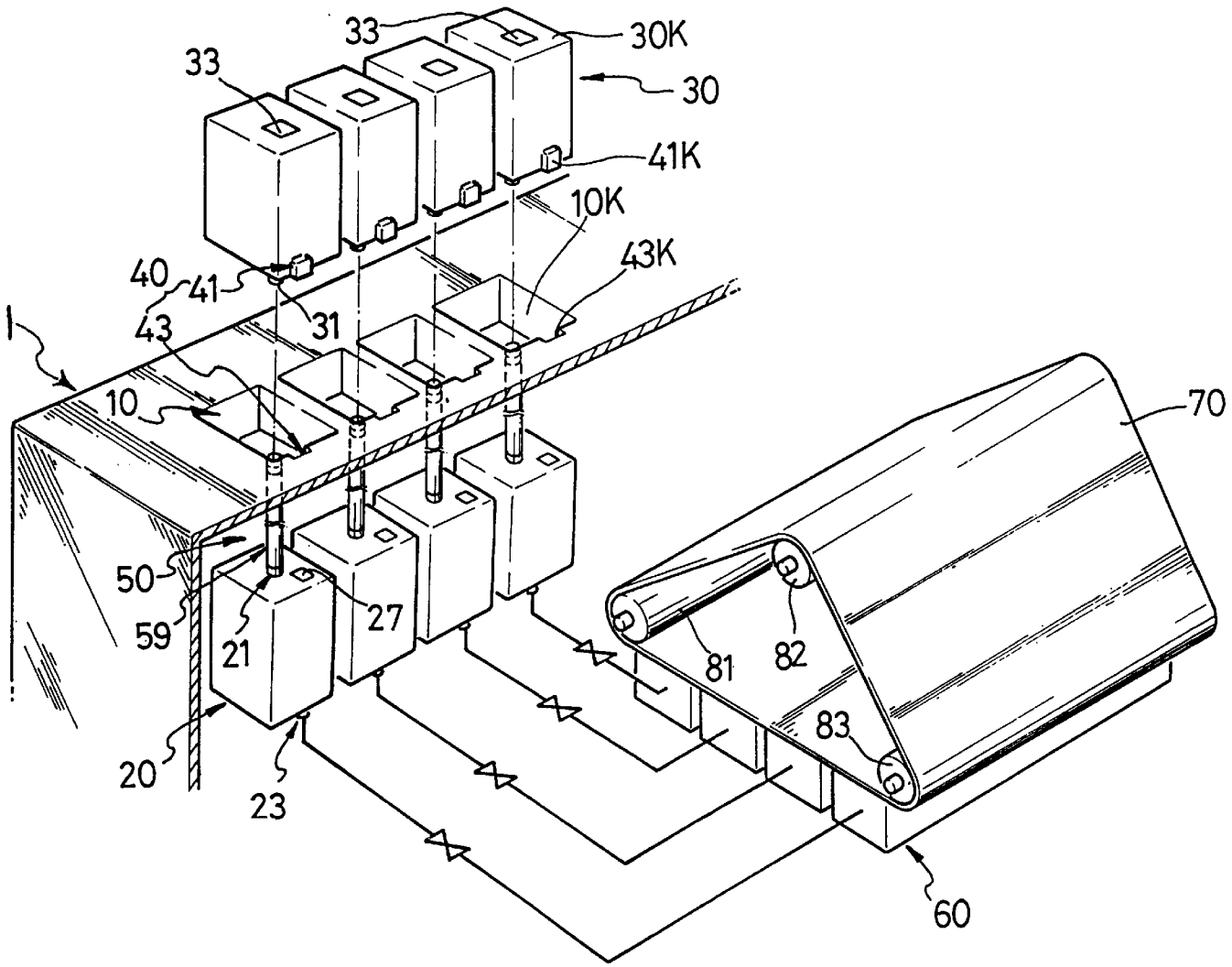
FIG. 1 is a perspective view of an ink supply apparatus for a wet electrophotographic printer according to a preferred embodiment of the present invention.

Referring to FIG. 1, which shows an ink supply apparatus according to a first embodiment of the present invention, a plurality of installation portions 10 coupled with detachable refill cartridges 30 containing colors such as yellow, magenta, cyan and black are formed in a housing 1. Also, the housing 1 includes a developing unit 60, a photosensitive belt 70 installed to circulate around a plurality of rollers 81, 82 and 83, a carrier cartridge (not shown), a drying unit (not shown) and a transfer unit (not shown).

The refill cartridges 30 are installed with respect to color in the installation portions 10 by color identifying/installing means 40. The color identifying/installing means 40 includes a protrusion 41 and a groove 43 formed in the installation portion 10 to couple with the protrusion 41.

According to the present invention, the protrusion 41 is formed at a different position for each refill cartridge 30, and the position of the groove 43 in each installation portion, corresponding to the protrusion 41, is also different. Thus, the refill cartridge can be installed only in its designated installation portion 10 having the same color by the color identifying/installing means 40. For example, a protrusion 41K formed in a refill cartridge 30K for black can be coupled with only a groove 43K formed in an installing portion 10K for black and not in the grooves of other installation portions. This is for preventing mis-installation of the refill cartridges 30.

In this embodiment, the protrusion is formed in the refill cartridge and the groove is formed in the installation portion. Alternatively, the groove may be formed in the refill cartridge while the protrusion is formed in the installation portion.

Ink contained in the refill cartridge 30 flows into the ink cartridge placed in the housing 1 by an ink supply means 50.

More specifically, the ink cartridge 20 has an intake hole 21 for receiving ink from the corresponding refill cartridge 30 and a supply hole 23 for supplying contained ink to the developing unit 60. Also, the ink cartridge 20 has functional parts such as an agitator, etc. and is not replaced when ink is completely consumed.

Figure 2:
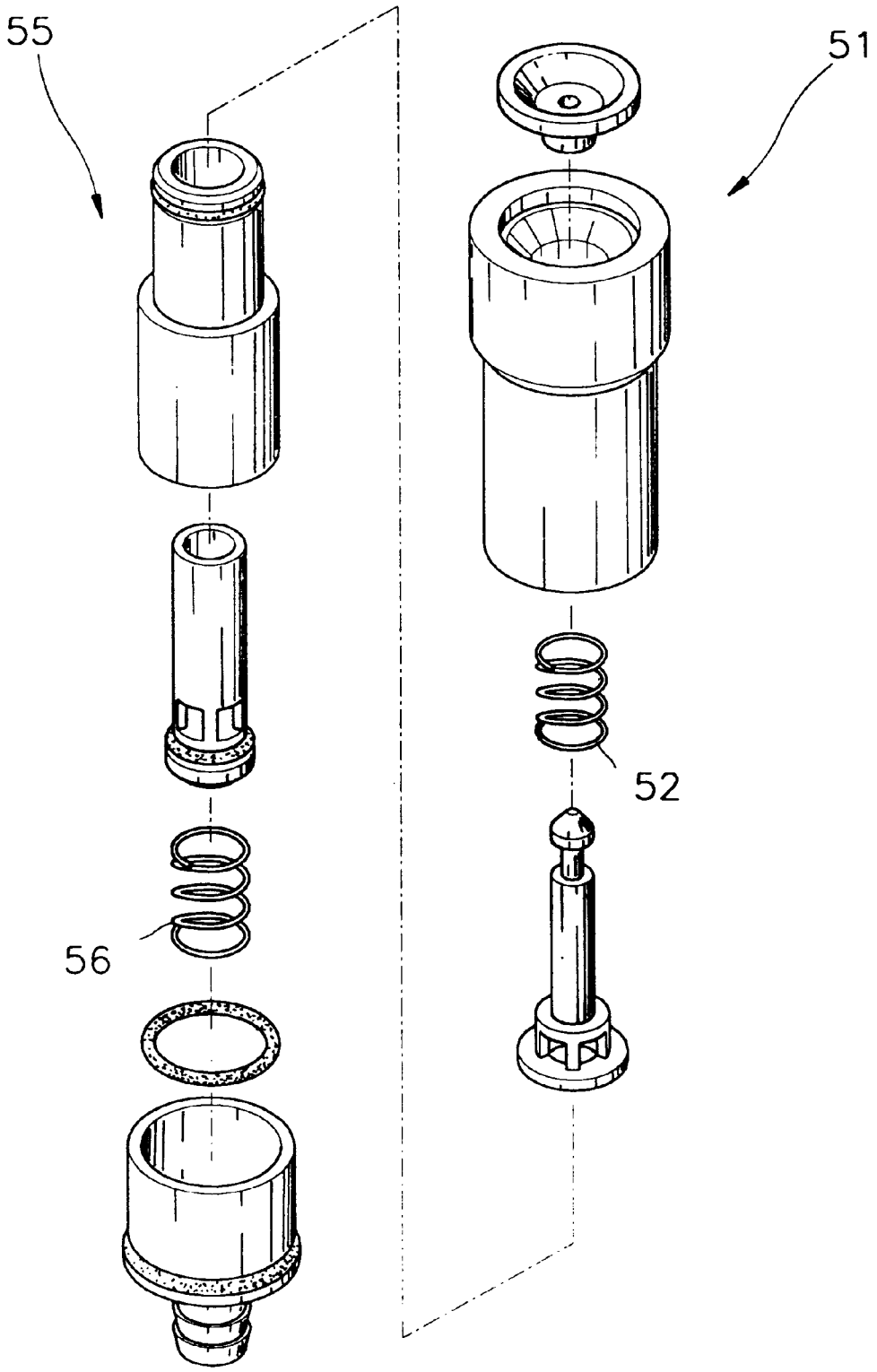
FIG. 2 is an exploded perspective view of first and second valve elements shown in FIG. 1.
Figure 3:
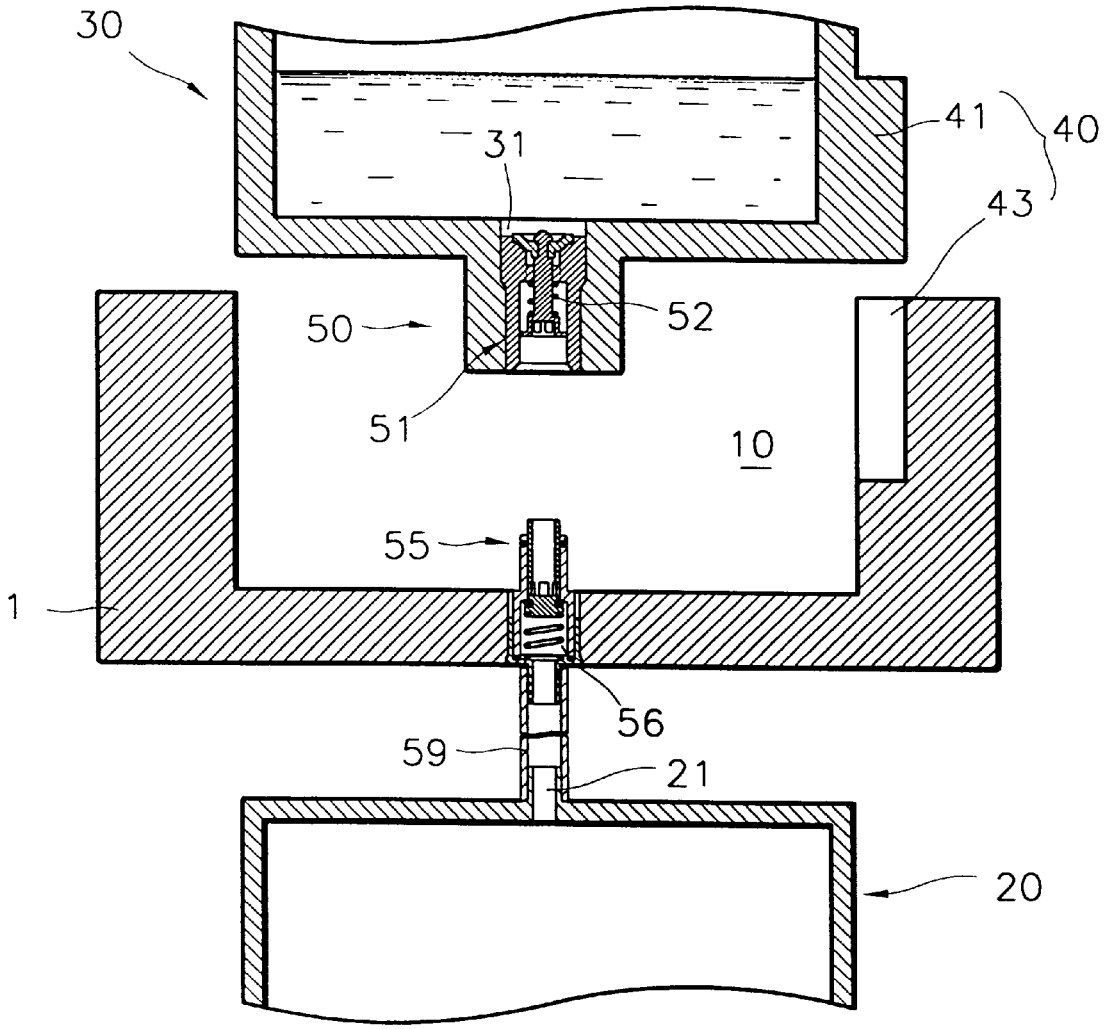
FIG. 3 is a vertical section view showing a state in which an ink supply means of FIG. 1 is detached.
Figure 4:
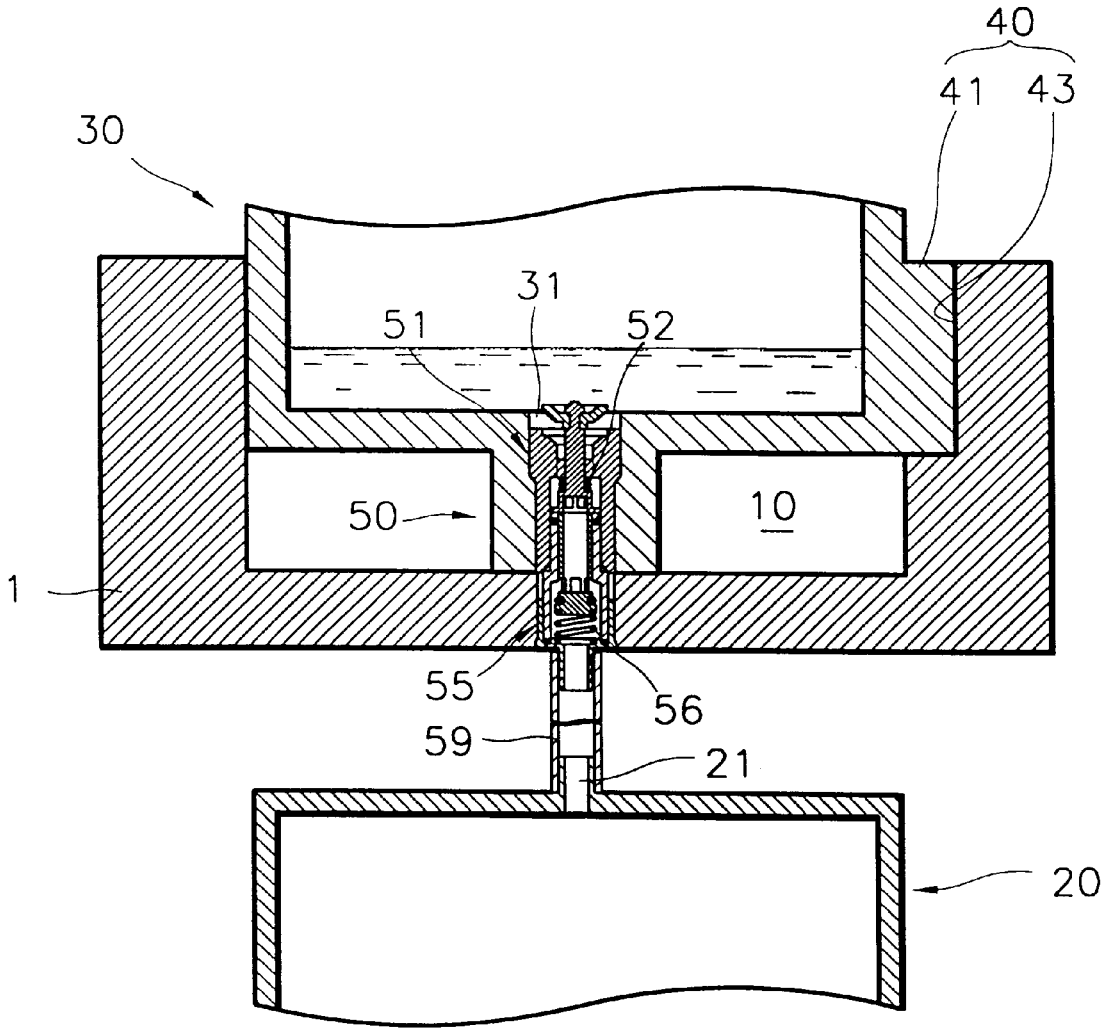
FIG. 4 is a vertical section view showing a state in which an ink supply means of FIG. 1 is installed.

Referring to FIGS. 2 through 4, the ink supply means 50 includes a first valve element 51 positioned at a discharge hole 31 of the refill cartridge 30 and a second valve element 55 installed at the bottom of the installation portion 10. Also, the second valve element 55 is communicated with the intake hole 21 of the ink cartridge 20 via a path 59.

The first valve element 51 and the second valve element 55 are a pair of valve assemblies such as a shut-off valve. That is, the valve elements 51 and 55 are closed by springs 52 and 56 installed therein, respectively, and coupled to each other to thereby open into each other.

Thus, when the first and second valve elements 51 and 55 are coupled, the intake hole 21 leads to the discharge hole 31, so ink contained in the refill cartridge 30 is provided to the ink cartridge 20 via the path 59 as shown in FIG. 4.

Figure 5:
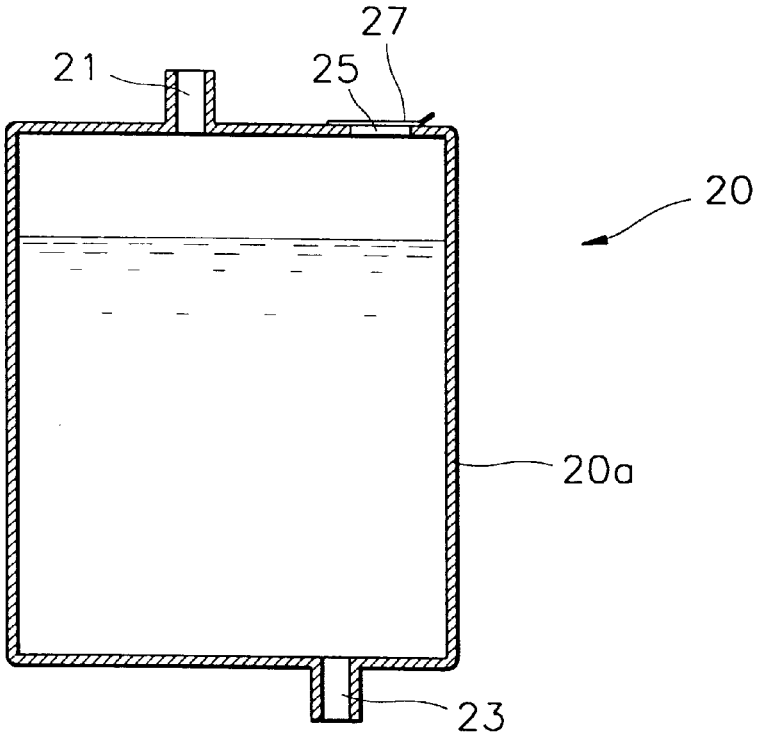
FIG. 5 is a vertical section view showing an example of an ink cartridge used in the ink supply apparatus according to the present invention.

An ink cartridge adopted in the ink supply apparatus according to the present invention is shown in FIG. 5. As shown in FIG. 5, the ink cartridge 20 includes an ink cartridge case 20*a* having an air discharge hole 25, and a lid 27 for opening/closing the air discharge hole 25.

The ink cartridge case 20*a* contains ink provided via the intake hole 21 from the refill cartridge 30 (see FIG. 1), and provides the ink to the developing unit 60 (see FIG. 1) via the supply hole 23. Also, the lid 27 is opened or closed according to the internal pressure of the ink cartridge case 20*a*. That is, when ink is provided from the refill cartridge 30, the lid 27 is opened, so air is discharged from the ink cartridge case 20*a* through the air discharge hole 25. After supply of ink is completed, the lid 27 closes the air discharge hole 25 by its own weight or elastic force.

Figure 6:
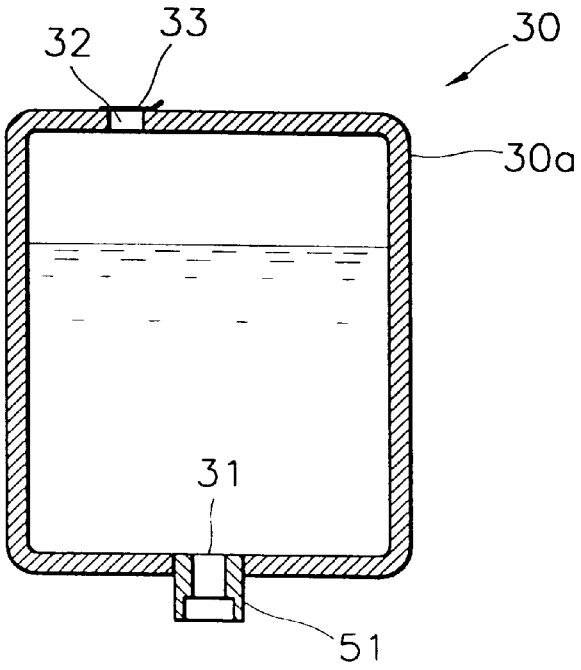
FIGS. 6 through 8 are vertical section views showing examples of a refill cartridge used in the ink supply apparatus according to the present invention.

Referring to FIG. 6, which shows the refill cartridge 30, an air intake hole 32 is formed on a refill cartridge case 30*a* containing ink having a predetermined color, and the air intake hole 32 is sealed by a lid 33.

More specifically, when the lid 33 is detached after loading the refill cartridge 30 in the installation portion 10 (see FIG. 1), ink contained in the refill cartridge case 30*a* flows into the ink cartridge 20 via the first and second valve elements 51 and 55 and the path 59.

Figure 7:
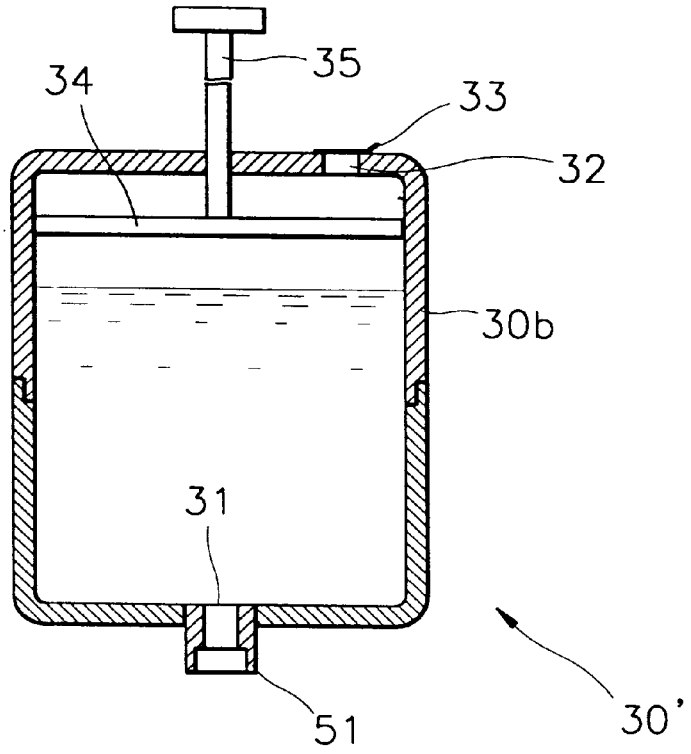
Figure 8:
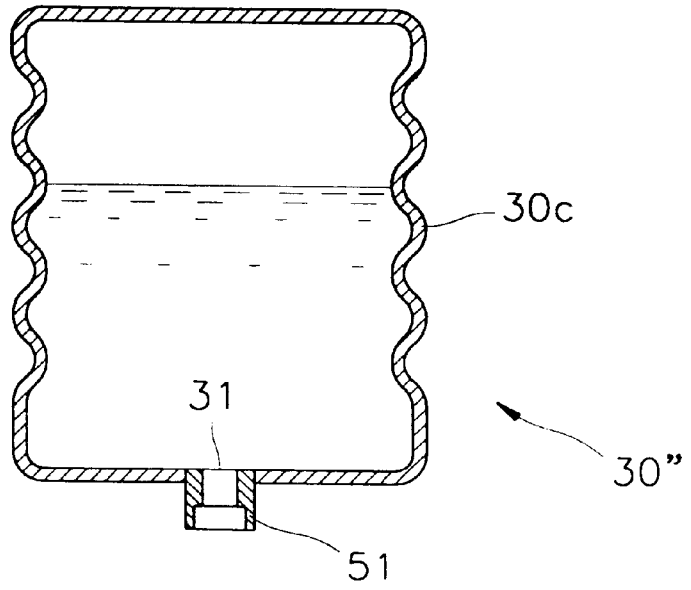

Other examples of the refill cartridge are shown in FIGS. 7 and 8. In this case, the same reference numerals represent the same elements.

Referring to FIG. 7, there is a piston 34 and a rod 35 for rapidly supplying ink contained in a refill cartridge 30' to the ink cartridge 20 (see FIG. 1). That is, the piston 34 is slidably installed within a refill cartridge case 30*b*, and the rod 35 is connected to the piston 34 through the refill cartridge case 30*b*. Thus, the rod 35 is pushed such that the piston 34 provides pressure over the ink contained in the refill cartridge case 30*b*, thereby rapidly supplying ink via the discharge hole 31.

A refill cartridge 30" shown in FIG. 8 includes a refill cartridge case 30*c* having a structure of a bellows in which ink contained in the case is discharged via the discharge hole 31 when the bellows is compressed by external pressure. In this case, an air discharge hole and a lid are not necessary, so that the structure of the refill cartridge is simplified and ink is rapidly injected. Alternatively, the refill cartridge 30" may be formed of a flexible material.

An ink supply apparatus of a wet electrophotographic printer according to a second embodiment of the present invention will be described with reference to FIGS. 9 and 10.

According to this embodiment, an installation portion 110 having a plurality of grooves 143 for loading each refill cartridge 130 by color is formed in the outer surface of a housing 101. More specifically, a protrusion 141 is formed at a different position on each refill cartridge 130, and coupled with its corresponding groove 143 according to its color.

In this embodiment, a plurality of refill cartridges 130 can be loaded in one installation portion 110 by color, to refill the ink cartridge with desired ink.

Also, each refill cartridge 130 has a discharge hole 131 at different positions by color, and a first valve element 151 is installed at the discharge hole 131.

A plurality of second valve elements 155*a*, 155*b*, 155*c* and 155*d* for each color, to be coupled with the first valve elements 151, are placed at the bottom of the installation portion 110. That is, the second valve elements 155*a* through 155*d* are selectively coupled with the first valve elements 151 formed at different positions of each refill cartridge by color, so ink is provided to ink cartridges 120*a*, 120*b*, 120*c* and 120*d* via a plurality of paths 159*a*, 159*b*, 159*c* and 159*d*.

In this embodiment, the plurality of second valve elements 155*a* through 155*d*, each corresponding to the discharge hole 131 and the first valve element 151 of the refill cartridge 130 for a predetermined color, are installed in one installation portion 110 by color, thereby increasing the efficiency in the use of space.

Figure 11:
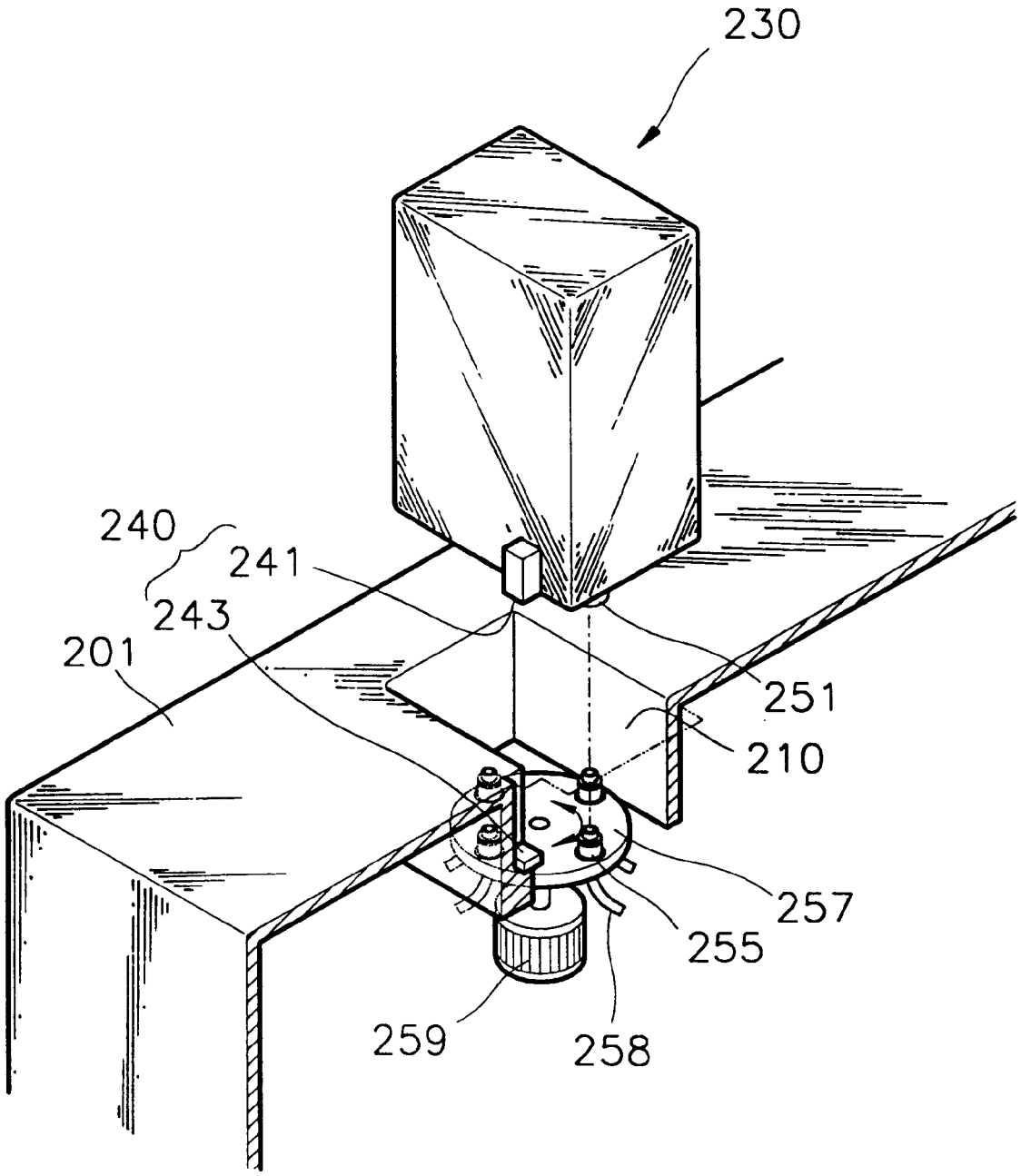
FIG. 11 is a perspective view of an ink supply apparatus for a wet electrophotographic printer according to still another embodiment of the present invention.

An ink supply apparatus for a wet electrophotographic printer according to a third embodiment of the present invention is shown in FIG. 11.

Figure 9:
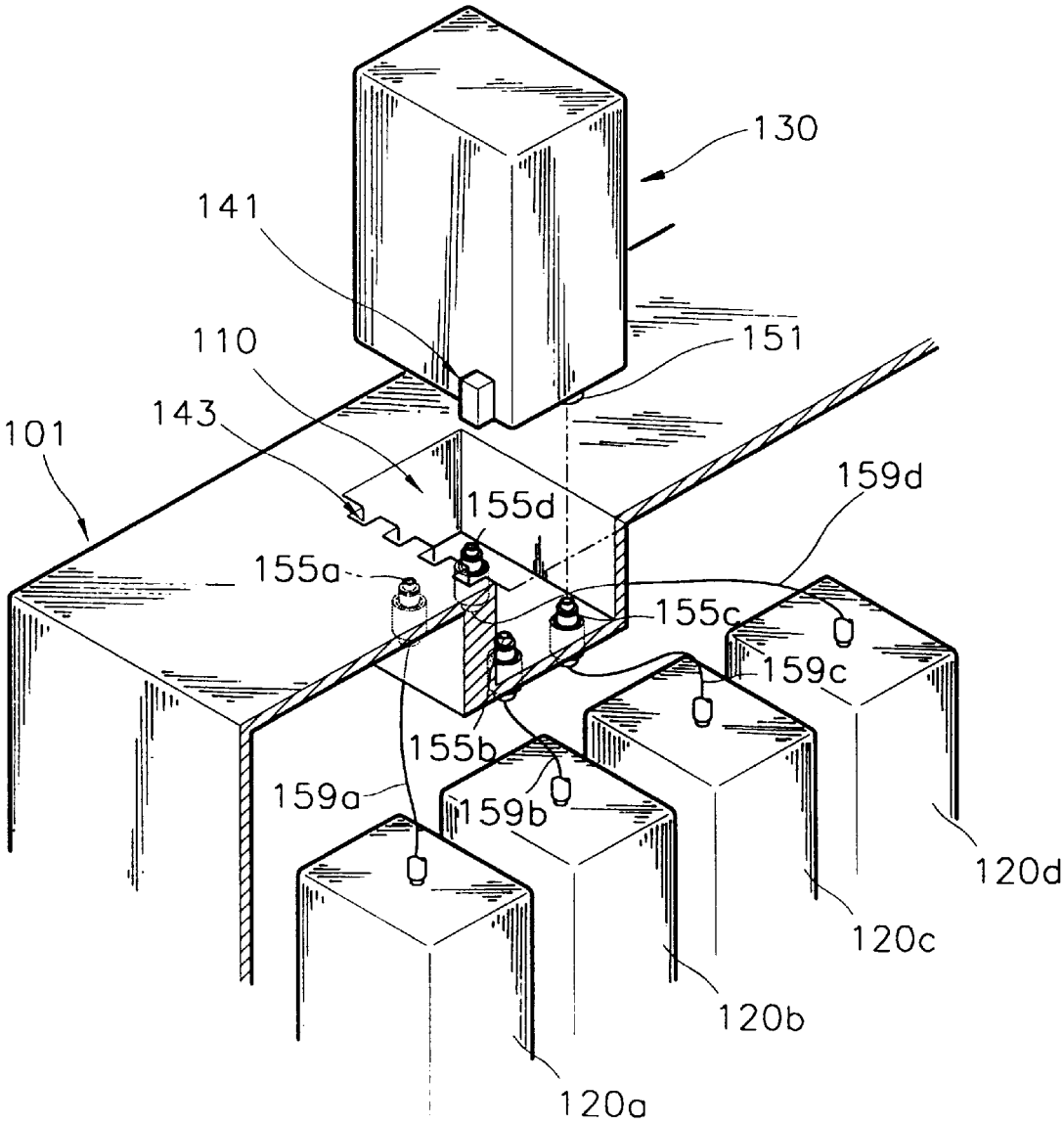
FIG. 9 is a perspective view of an ink supply apparatus for a wet electrophotographic printer according to another embodiment of the present invention.
Figure 10:
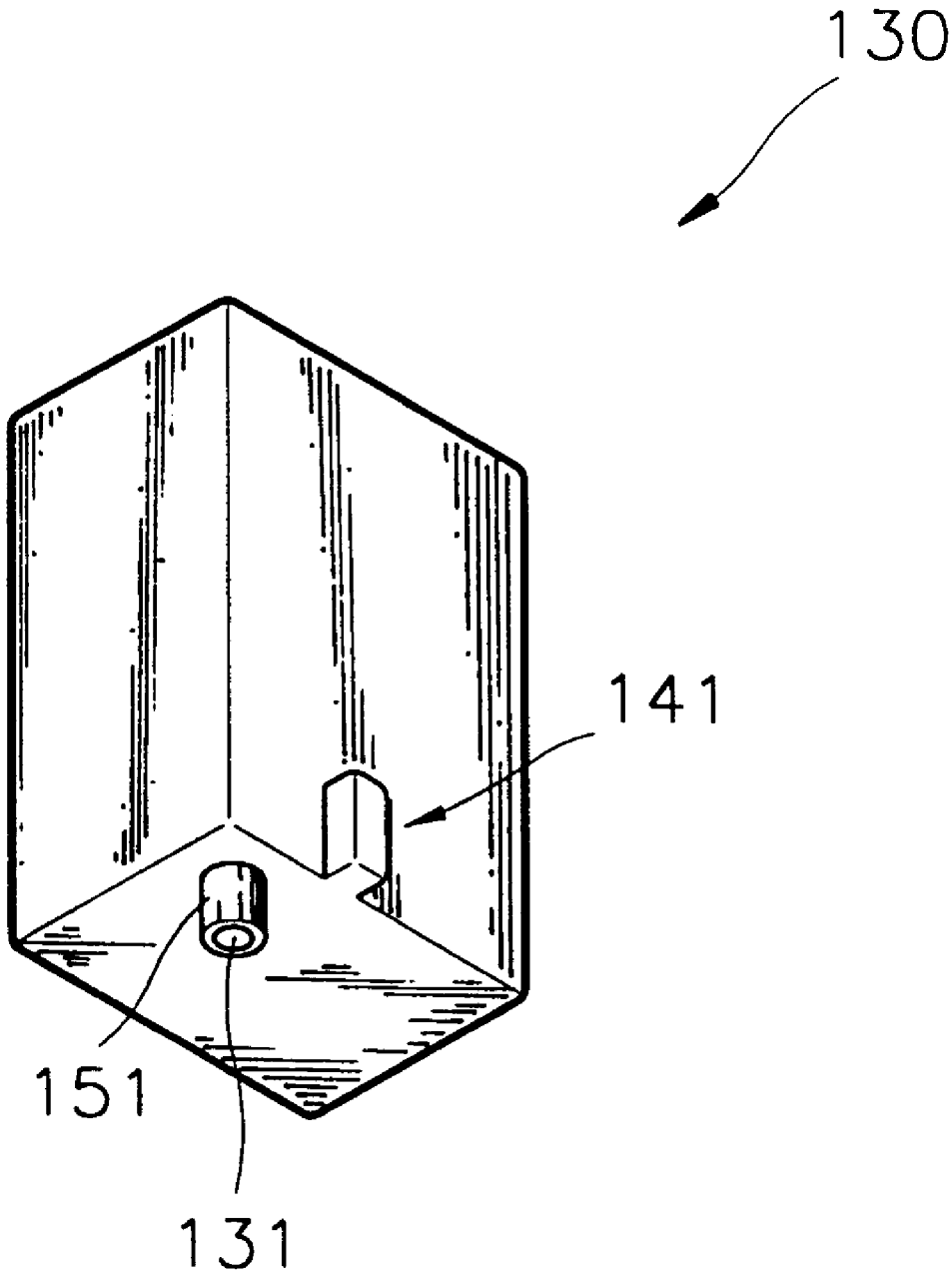
FIG. 10 is a perspective view from the bottom of the refill cartridge used in the ink supply apparatus shown in FIG. 9.

As in the second embodiment of FIG. 9, a plurality of refill cartridges 230 for each color is loaded in one installation portion 210 formed in a housing 201.

An ink supply means includes a first valve element 251 socketed at a discharge hole (not shown) of the refill cartridge 230, a rotary plate 257 rotatably installed at the bottom of the installation portion 210, a driving motor 259 for driving the rotary plate 257, and a plurality of second valve elements 255 located at the rotary plate 257.

A color identifying/installing means 240 of this embodiment includes an indicator 241 placed at the refill cartridge 230, for indicating the color of ink contained in the refill cartridge 230, and a sensor 243 installed in the installation portion 210, opposite to the indicator 241. That is, when the refill cartridge 230 is loaded in the installation portion 210, the sensor 243 senses the indicator 241 to identify the color of ink contained in the refill cartridge 130.

A signal sensed by the sensor 243 is transmitted to a controller (not shown), and the controller rotates the rotary plate 257 by driving the driving motor 259 such that the second valve element 255 located in the rotary plate 257 is coupled with the corresponding first valve element 251 of the refill cartridge 230.

Thus, ink contained in the refill cartridge 230 can be provided to an ink cartridge (not shown) via the path 258.

In the ink supply apparatus according to the present invention, when ink is completely consumed, only the refill cartridge is replaced while the ink cartridge having functional parts such as an agitator, a dripless valve, an air hole and an attach/detachment equipment is fixed to the printer main body, thereby lowering costs required for replacing the parts.

Also, because replacing the ink cartridge is not necessary, the ink cartridge can be fixed in an appropriate position for printing within the housing of the main body, providing flexibility in the installation of the ink cartridge.

The present invention discloses an ink supply apparatus for a color printer. However, the ink supply apparatus of the present invention can be applied to a monochrome printer without a color identifying/installing means.

It is contemplated that numerous modifications may be made to the ink supply apparatus for wet electrophotographic printer of the present invention without departing from the spirit and scope of the invention as defined in the following claims.

What is claimed is:

1. An ink supply apparatus for a wet electrophotographic color printer, comprising:

a housing having an installation portion;

a plurality of ink cartridges installed in the housing, for supplying ink having a predetermined color to corresponding developing units;

a plurality of detachable refill cartridges installed in the installation portion, for supplying ink having a predetermined color to a corresponding one of the ink cartridges; and a color identifying/installing mechanism for allowing ink having a predetermined color to be supplied to the corresponding ink cartridge from a corresponding one of the refill cartridges, wherein the color identifying/installing mechanism comprises:

a protrusion formed at different positions for each refill cartridge by color;

a plurality of grooves formed in the installation portion to be coupled with a corresponding protrusion;

a discharge hole formed in different positions for each refill cartridge by color;

a first valve element installed at each discharge hole; and a plurality of second valve elements installed in the installation portion to be connected with an ink intake hole of a corresponding one of the ink cartridges, each of which is coupled with a corresponding first valve element by color when the refill cartridges are installed in the installation portion.

2. An ink supply apparatus for a wet electrophotographic color printer, comprising:

a housing having an installation portion;

a plurality of ink cartridges, installed in the housing for supplying ink having a predetermined color to corresponding developing units;

a plurality of detachable refill cartridges installed in the installation portion, for supplying ink having a predetermined color to a corresponding one of the ink cartridges; and a color identifying/installing mechanism for allowing ink having a predetermined color to be supplied to the corresponding ink cartridge from a corresponding one of the refill cartridges, wherein the color identifying/installing mechanism comprises:

an indicator formed at each refill cartridge, for indicating the color of ink contained in the refill cartridge;

a sensor for sensing the indicator to detect the color of ink contained in the refill cartridge;

a discharge hole formed in different positions for each refill cartridge by color;

a first valve element installed at each discharge hole;

a plurality of second valve elements connected with an ink intake hole of the ink cartridge, each of which is coupled with a corresponding first valve element;

a rotary plate on which the plurality of second valve elements are installed; and a driving source for rotating the rotary plate, wherein the rotary plate is rotated by the driving source according to a detected signal of the sensor when the refill cartridges are loaded in the installation portion, thereby coupling the first valve elements and the second valve elements corresponding to each other.

* * * * *